US005938424A

United States Patent [19]

Kurogi et al.

[11] Patent Number: 5,938,424

[45] Date of Patent: Aug. 17, 1999

[54] FAILURE DIAGNOSING APPARATUS FOR COMBUSTION SYSTEMS

[75] Inventors: Yasuharu Kurogi, Hirakata; Norikazu Kubota, Ora-gun; Tomohiko Oka, Tokyo, all of Japan

[73] Assignee: Sanyo Electric Co., Ltd., Osaka, Japan

[21] Appl. No.: 08/736,583

[22] Filed: Oct. 24, 1996

[30] Foreign Application Priority Data

Oct. 26, 1995 [JP] Japan ..... 7-302030

[51] Int. Cl.[6] ..... F23D 5/12; F23N 5/26

[52] U.S. Cl. ..... 431/13; 431/14; 431/18; 431/25; 702/183; 702/185; 702/186; 364/528.09

[58] Field of Search ..... 431/13, 14, 8, 431/18, 25; 364/551.01, 550, 528.09; 702/183, 185, 186; 236/15 BR, 11, 10

[56] References Cited

U.S. PATENT DOCUMENTS 5,612,904 3/1997 Bunting ..... 431/13

*Primary Examiner*—Larry Jones

*Attorney, Agent, or Firm*—Nikaido, Marmelstein, Murray & Oram LLP

[57] ABSTRACT

An apparatus 9 for diagnosing failures in the combustion system to be installed in the regenerator of an absorption chiller is adapted to automatically prepare quantitative diagnosis data from a plurality of items of measurement data. The apparatus comprises an abnormality degree calculating circuit 2 for calculating degrees of abnormality serving as indexes for discriminating failures, from different items of data obtained by a combustion system control unit 1, a binary conversion circuit 4 for converting the abnormality degrees obtained from the circuit 2 to binary data representing "normal" or "abnormal," a condition judging circuit 5 for discriminating types of states of failures from the binary data by driving a diagnosis knowledge base 7, and a diagnosis data calculating circuit 6 for calculating diagnosis data from the abnormality degrees and types of failure states by driving the base 7.

13 Claims, 9 Drawing Sheets

| CONDITION | SYMPTOM | FAILURE | | | | |
|---|---|---|---|---|---|---|
| | | FAILURE V | FAILURE W | FAILURE X | FAILURE Y | FAILURE Z |
| CONDITION 1 | INDEX A | STRONG | | | | |
| | INDEX B | | MEDIUM | | | |
| | INDEX C | MEDIUM | WEAK | WEAK | | |
| CONDITION 2 | INDEX A | WEAK | STRONG | MEDIUM | WEAK | |
| | INDEX E | | | MEDIUM | MEDIUM | |
| CONDITION 3 | INDEX A | | | | STRONG | MEDIUM |
| CONDITION 4 | INDEX D | | | | | MEDIUM |

FIG.7

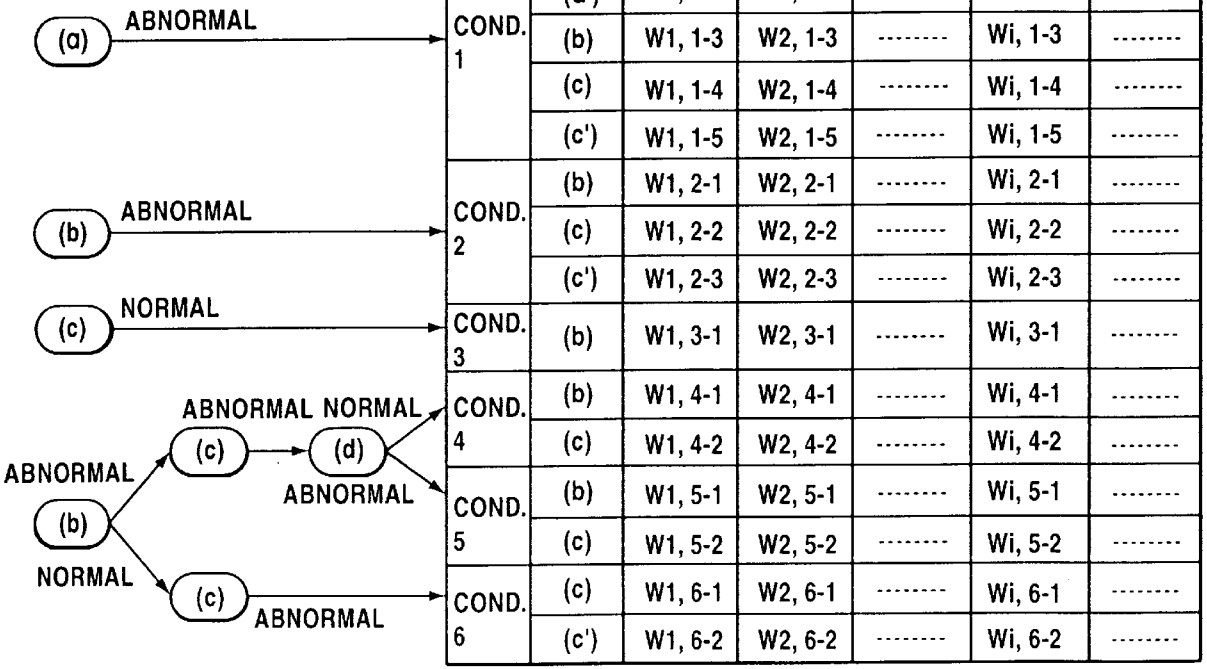

| | DATA | FAILURE CAUSE 1 | FAILURE CAUSE2 | ..... | FAILURE CAUSE i | ..... |
|---|---|---|---|---|---|---|
| COND. 1 | (a) | W1, 1-1 | W2, 1-1 | ..... | Wi, 1-1 | ..... |
| | (a') | W1, 1-2 | W2, 1-2 | ..... | Wi, 1-2 | ..... |
| | (b) | W1, 1-3 | W2, 1-3 | ..... | Wi, 1-3 | ..... |
| | (c) | W1, 1-4 | W2, 1-4 | ..... | Wi, 1-4 | ..... |
| | (c') | W1, 1-5 | W2, 1-5 | ..... | Wi, 1-5 | ..... |
| COND. 2 | (b) | W1, 2-1 | W2, 2-1 | ..... | Wi, 2-1 | ..... |
| | (c) | W1, 2-2 | W2, 2-2 | ..... | Wi, 2-2 | ..... |
| | (c') | W1, 2-3 | W2, 2-3 | ..... | Wi, 2-3 | ..... |
| COND. 3 | (b) | W1, 3-1 | W2, 3-1 | ..... | Wi, 3-1 | ..... |
| COND. 4 | (b) | W1, 4-1 | W2, 4-1 | ..... | Wi, 4-1 | ..... |
| | (c) | W1, 4-2 | W2, 4-2 | ..... | Wi, 4-2 | ..... |
| COND. 5 | (b) | W1, 5-1 | W2, 5-1 | ..... | Wi, 5-1 | ..... |
| | (c) | W1, 5-2 | W2, 5-2 | ..... | Wi, 5-2 | ..... |
| COND. 6 | (c) | W1, 6-1 | W2, 6-1 | ..... | Wi, 6-1 | ..... |
| | (c') | W1, 6-2 | W2, 6-2 | ..... | Wi, 6-2 | ..... |

<MEASUREMENT DATA>
a SPARK DETECTION TIME
a' FREQUENCY OF ABNORMALITY OCCURRENCE IN (a)
b IGNITION TRANSFORMER PRIMARY CURRENT
c FLAME CURRENT PRODUCED WITH SPARK CHECK TIMING
c' FREQUENCY OF ABNORMALITY OCCURRENCE IN (c)
d FLAME CURRENT PRODUCED WITH IGNITION TRIAL TIMING

| | DATA | FAILURE CAUSE 1 | FAILURE CAUSE2 | ..... | FAILURE CAUSE i | ..... |
|---|---|---|---|---|---|---|
| COND. 1 | (b) | W1, 1-1 | W2, 1-1 | ..... | Wi, 1-1 | ..... |
| COND. 2 | (c) | W1, 2-1 | W2, 2-1 | ..... | Wi, 2-1 | ..... |
| COND. 3 | (d) | W1, 3-1 | W2, 3-1 | ..... | Wi, 3-1 | ..... |
| COND. 4 | (c) | W1, 4-1 | W2, 4-1 | ..... | Wi, 4-1 | ..... |
| COND. 5 | (c) | W1, 5-1 | W2, 5-1 | ..... | Wi, 5-1 | ..... |
| | (d) | W1, 5-2 | W2, 5-2 | ..... | Wi, 5-2 | ..... |

<MEASUREMENT DATA>
a FLAME CURRENT PRODUCED WITH PILOT ONLY TIMING
b FLAME CURRENT IN FIRST PERIOD OF MAIN TRIAL TIMING
c FLAME CURRENT IN FOLLOWING PERIOD OF MAIN TRIAL TIMING
d FLAME CURRENT PRODUCED WITH MAIN STABILIZING TIMING

FAILURE DIAGNOSING APPARATUS FOR COMBUSTION SYSTEMS

FIELD OF THE INVENTION

The present invention relates to apparatus for diagnosing failures in combustion systems provided for the high temperature generators of absorption chillers, large-sized boilers and the like.

BACKGROUND OF THE INVENTION

Absorption chillers comprise a condenser, evaporator, absorber, generator, heat exchanger, etc. which are interconnected by piping. The generator is equipped with a combustion system for heating lithium bromide or like absorbent having absorbed a refrigerant to concentrate the absorbent. For example, a fuzzy control system has been proposed for controlling such absorption chillers (U.S. Pat. No. 5,224,352).

With reference to FIG. 2, the combustion system provided for the generator of the absorption chiller comprises a main burner 15 installed in a combustion chamber 10, a pilot burner 17 for igniting the main burner 15 and a spark rod 20 for igniting the pilot burner 17. First, the spark rod 20 generates a spark, igniting the pilot burner 17, and the flame produced by the pilot burner 17 ignites the main burner 15.

Operated in a predetermined sequence in this process are a plurality of devices constituting the combustion system which include an ignition transformer 19 for causing the spark rod 20 to produce sparks, and pilot valves 16 and main valves 12, 13 for supplying a fuel to the respective burners.

The flames produced by the main burner and pilot burner and the spark generated by the spark rod are detected by a flame sensor 21, and the resulting detection signals are incorporated into the operation sequence.

With the combustion system thus comprising a plurality of devices, failures could occur during the predetermined sequence of operations of the devices. In this case, a failure will exert influences of varying intensities on various items of measurement data representing the behavior of the devices, e.g., the time (spark detection time) from the application of voltage to the ignition transformer until the spark rod produces a spark, the current flowing through the primary side of the ignition transformer, and the flame current produced from the flame sensor.

Upon the combustion system developing some failure, therefore, the maintenance inspector observes variations in the measurement data with the progress of the combustion system operation sequence to diagnose the cause of the failure.

With the combustion system, however, not only one failure influences a plurality of items of measurement data with varying intensities, but a plurality of different failures will occur at the same time, synergically affecting a single item of measurement data, or one failure could influence different items of measurement data owing to a difference in the state of failure. Diagnosing the causes of failures based on the observation of measurement data therefore requires a long experience and sophisticated knowledge. For this reason, inspectors of small Experience encounter the problem of necessitating much time in determining the causes of failures owing to extreme difficulties involved in diagnosis.

SUMMARY OF THE INVENTION

An object of the present invention is to provide a failure diagnosing apparatus for combustion systems which automatically and quantitatively derives diagnosis data from a plurality of items of measurement data so as to enable even an insufficiently experienced inspector to readily determine the causes of failures.

The present invention provides an apparatus for diagnosing failures in a combustion system which apparatus comprises:

(a) means for measuring different items of measurement data representing the behavior of each component device of the combustion system during the operation of the system in a predetermined sequence, (b) a diagnosis knowledge base having stored therein as knowledge data the causal relation of different kinds of failures to causes which failures can occur in one or a plurality of component devices to be inspected for diagnosis, in connection with the different items of measurement data to be obtained from the measuring means, and (c) knowledge base drive means for driving the diagnosis knowledge base based on the measurement data obtained from the measuring means and deriving diagnosis data as to the causes of failures.

With the failure diagnosing apparatus described, the diagnosis knowledge base has stored therein, as knowledge, data knowledge as to the causes of failures acquired by skilled maintenance inspectors through their experiences. Accordingly, diagnosis data as to the cause of a particular failure can be obtained by driving the diagnosis knowledge base with reference to items of measurement data. The diagnosis data is quantitative, and directly represents the cause of the failure or includes suggestions as the true cause of the failure.

More specifically stated, the knowledge base drive means comprises data processing means for preparing different items of index data serving as judging indexes in diagnosing failures, based on the measurement data obtained from the measuring means. On the other hand, the diagnosis knowledge base comprises a condition knowledge portion having defined therein conditions for discriminating types of states of failures based on the index data, the conditions being classified for the respective types, and a connection strength knowledge portion having defined therein the strength of connection between one item or different items of index data and the causes of a plurality of failures, for every failure type.

The knowledge base drive means discriminates the types of failure states from the index data with reference to the condition knowledge portion of the diagnosis knowledge base and thereafter calculates, from the index data for each type discriminated, diagnosis data representing the probability that the cause of the failure will be the true cause with reference to the connection strength knowledge portion.

With combustion systems, not only one failure influences a plurality of items of index data (symptoms) with varying intensities, but a plurality of different failures will occur at the same time, synergically affecting a same item of index data, or one failure could influence different items of measurement data owing to a different state of the failure. FIG. 5 shows this schematically. A cause of failure will appear as different symptoms owing to a difference in the condition involved, or is likely to result in a plurality of symptoms even under the same condition. The condition under which the cause and the symptom are related or connected to each other is dependent on the operation sequence of the combustion system; it is thought that different conditions lead to different types of failures.

It is empirically found that the failures of the combustion system involve different types as to the state of failures;

when the relationships between the causes of failures and the resulting symptoms are analyzed in order according to the type, one-to-one relation is found therebetween as is empirically known. FIG. 6 shows the relations between the causes of failures and the symptoms as classified in order according to the condition. When the failures identified by establishing one condition are observed from type to type, a definite corresponding relation is established between one cause of failure and the resulting failures. For example with reference to FIG. 6, when a cause of failure, V, occurred, condition 1 and condition 2 result in different symptoms. More specifically, under condition 1, the cause exerts a strong influence on index data A, a medium influence on index data C and no influence on other index data, whereas under condition 2, the cause exercises a weak influence on index data A but no influence on other index data. Other causes also lead to different symptoms under different conditions. If failures are diagnosed without classifying these states according to the condition, the cause of the failure can not be identified.

With the apparatus described above, therefore, the diagnosis knowledge base comprises a condition knowledge portion and a connection strength knowledge portion. Referring to the condition knowledge portion, the knowledge base drive means first discriminates the conditions set for different types of failure states to derive one or a plurality of types to be considered in tracing the causes of a particular failure. With reference to the connection strength knowledge portion, the base drive means thereafter calculates diagnosis data for each type of failure state. This method of diagnosis substantiates the relation between a particular symptom and the cause of failure for every type of failure state, hence accurate diagnosis.

The apparatus of the invention for diagnosing failures in the combustion system automatically affords, based on measurement data representing the behavior of the combustion system, quantitative diagnosis data which directly represents the cause of failure, or includes suggestions as to the true cause of failure, consequently enabling even inspectors of small experience to readily identify the cause.

BRIEF DESCRIPTION OF THE DRAWINGS

FIG. 7 is a diagram showing details of a diagnosis knowledge base as to an ignition transformer line;

DETAILED DESCRIPTION OF EMBODIMENTS

With reference to the drawings, a detailed description will be given of the present invention as embodied for the combustion system of an absorption chiller shown in FIG. 2.

Figure 2:
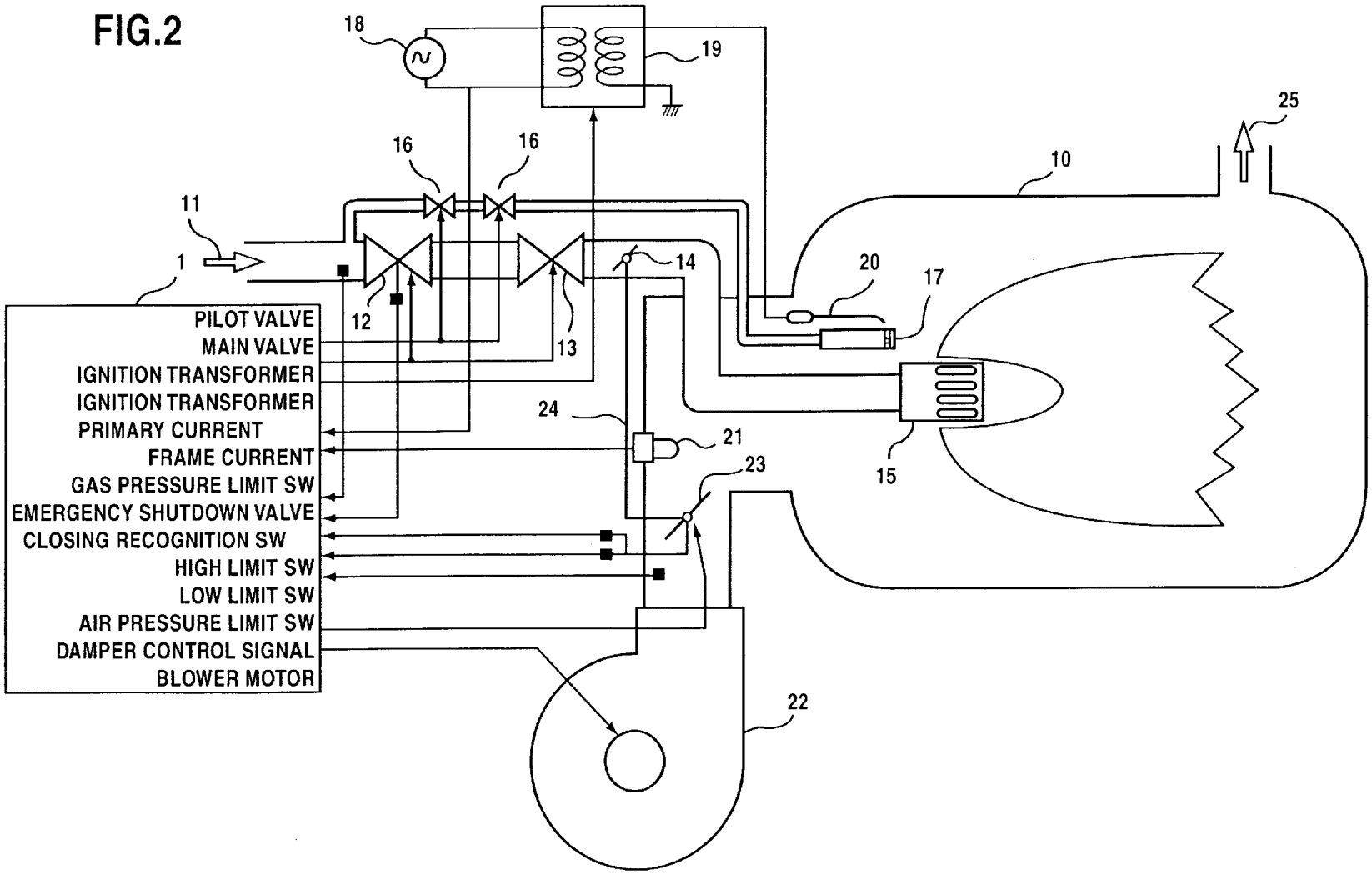
FIG. 2 is a schematic diagram showing the construction of a combustion system for which the invention is practiced.

Referring to FIG. 2, a combustion chamber 10 has installed therein a main burner 15, a pilot burner 17 disposed alongside the main burner 15, and a spark rod 20 disposed alongside the pilot burner 17. A blower 22 is connected to the combustion chamber 10 for supplying air for combustion.

Town gas 11 is supplied to the main burner 15 through main valves 12, 13 having the function of emergency shutdown valves, and to the pilot burner 17 via pilot valves 16. The flow rate of the town gas 11 to be supplied to the pilot burner 17, and the rate of the air to be sent into the combustion chamber 10 by the blower 22 are adjusted by respective dampers 14, 23 which are interconnected by a link mechanism 24. An ignition power source 18 is connected to the spark rod 20 by way of an ignition transformer 19.

When the main burner 15 is to be ignited, voltage is applied to the transformer 19 first, causing the spark rod 20 to generate a spark. Town gas 11 is supplied to the pilot burner 17 to ignite the pilot burner 17. Town gas 11 is then supplied to the main burner 15, igniting the main burner 15.

In this process, the spark generated by the spark rod 20, and the flame produced by the pilot burner 17 or the main burner 15 is detected by a flame sensor 21. The exhaust gas 25 inside the combustion chamber 10 is discharged to the outside.

Figure 3:
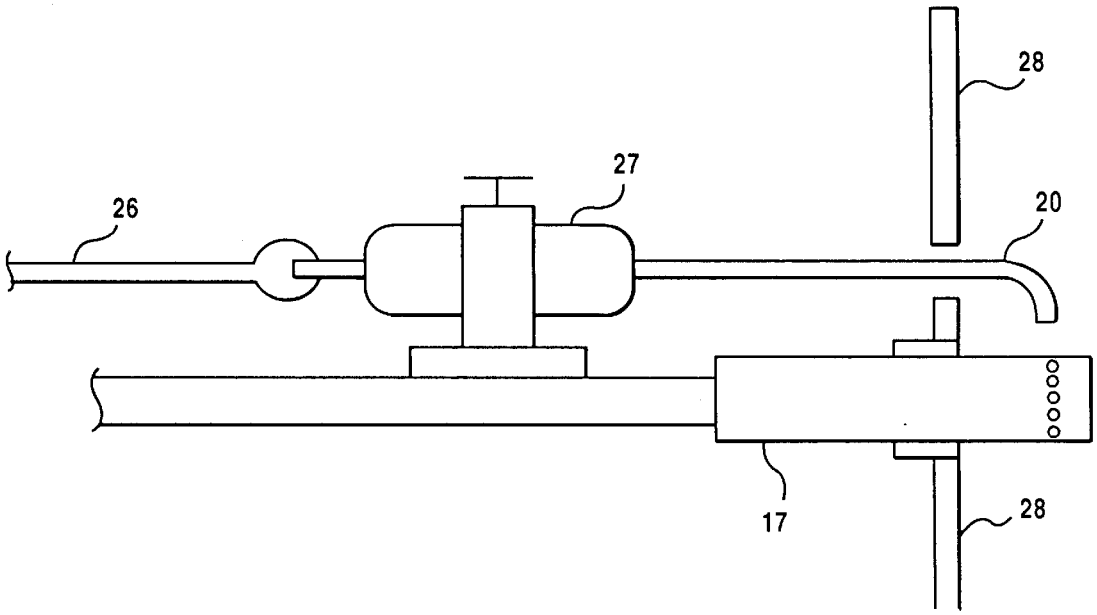
FIG. 3 is a side elevation showing a spark rod as supported in place.

FIG. 3 shows the spark rod 20 as installed in place. The spark rod 20 is supported by an insulator 27 on the pilot burner 17 and has a forward end projecting inwardly of the combustion chamber 10 through a flame stabilizing baffle 28 and a base end, which has connected thereto a cable 26 extending from the ignition power source 18.

Figure 4:
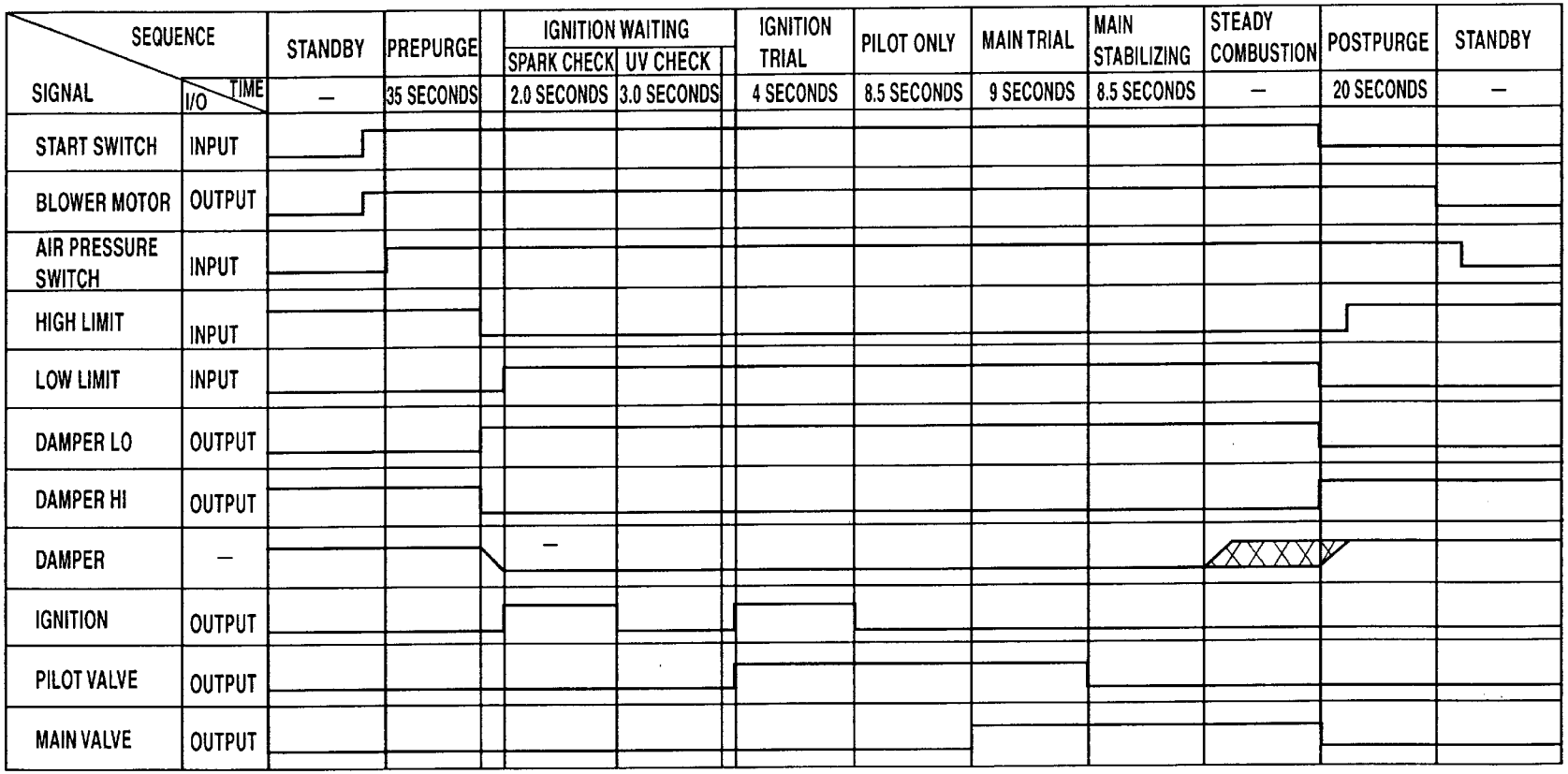
FIG. 4 is a diagram showing the operation sequence of the combustion system.
Figures 5, 6:
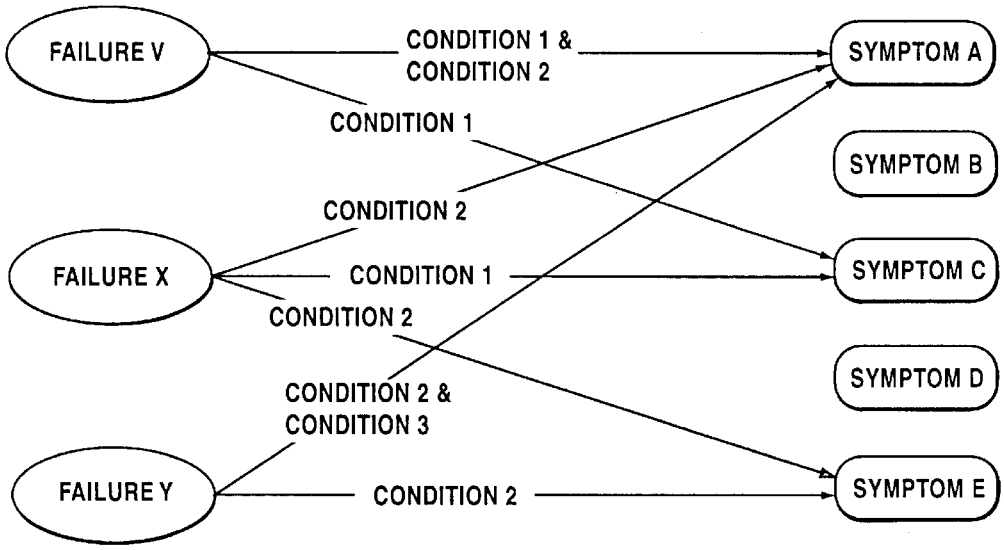
FIG. 5 is a diagram for illustrating the relation between causes of failures and symptoms.
FIG. 6 is a table for illustrating strengths of connections between indexes and causes of failures, as determined for every condition.

The sequence of operations for igniting the main burner 15 is controlled by a combustion system control unit 1. FIG. 4 shows this sequence to be executed by the control unit 1.

With "ignition waiting" timing, voltage is applied to the ignition transformer 19 for spark checking, followed by output signal checking (UV check) of the flame sensor 21, with the application of voltage to the transformer 19 interrupted. Next with "ignition trial" timing, voltage is applied to the transformer 19 with the pilot valves 16 open, causing the spark rod 20 to ignite the pilot burner 17 with a spark. Subsequently with "pilot only" timing, the application of voltage to the transformer 19 is discontinued. "Main trial" timing then follows to open the main valves 12, 13 and ignite the main burner 15. The supply of fuel to the pilot burner 17 is thereafter discontinued with "main stabilizing" timing, followed by "steady combustion."

Examples of failures in the ignition line include damage to or a fault or break in the cord of secondary winding of the ignition transformer, a connection fault in the transformer power source line and a drop in voltage supply. Examples of failures in the spark rod line are damage to the insulator, improper adjustment of the spark gap, a leak of spark current due to extraneous matter or dirt, etc. Examples of failures in the pilot burner line are an insufficient pilot burner input, improper adjustment of the air-fuel ratio, faulty pilot governor operation, etc. Examples of failures in the main burner line are a break in the burner, faulty flow rate control, faulty operation of the main shutdown valve, improper adjustment of the governor pressure and the like.

Figure 1:
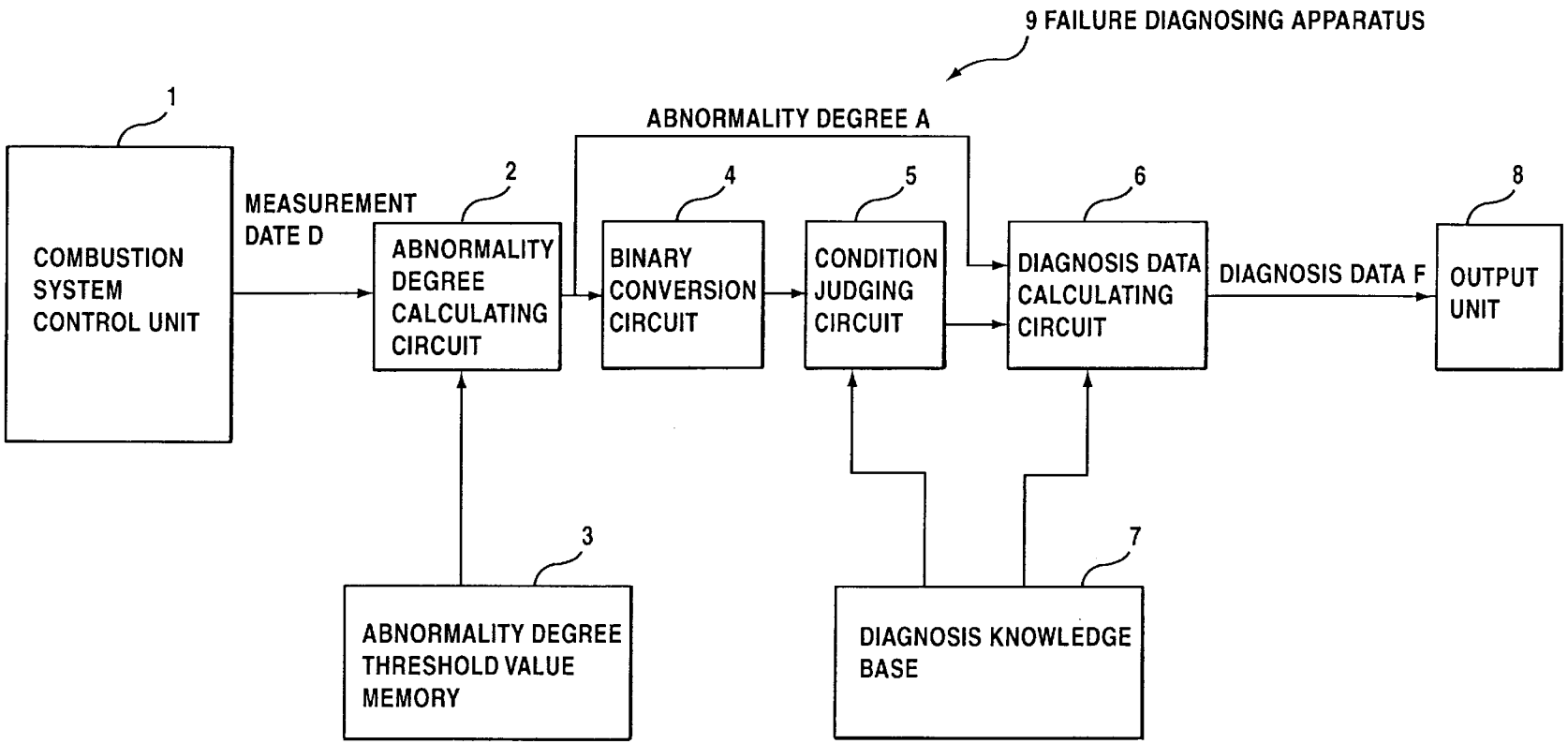
FIG. 1 is a block diagram showing the construction of a failure diagnosing apparatus embodying the invention.

FIG. 1 shows the construction of an apparatus 9 for diagnosing failures in the combustion system described. Various items of measurement data obtained from the combustion system control unit 1 are fed to the apparatus 9.

These items of data include:

period of time after the application of voltage to the ignition transformer until the detection of a spark generated by the spark rod (spark detection time), current through the primary winding of the ignition transformer (ignition transformer primary current), signal produced from the flame sensor with the spark check timing (flame current), flame current produced with the ignition trial timing, time lag between the supply of fuel to the pilot burner and the ignition of the pilot burner, flame current produced with the pilot only timing, flame current during the first 1.5-second period involved in the main trial timing, flame current during the following 7.5-second period involved in the main trial timing, and flame current produced with main stabilizing timing.

As to the ignition transformer primary current or the flame current, current values sampled suitably are averaged to obtain measurement data.

The combustion system shown in FIG. 2 are divided into four lines, i.e., the ignition transformer line, spark rod line, pilot burner line and main burner line. Examples of failure diagnosis apparatus 9 as adapted for the respective lines will be described below.

Ignition Transformer Line

The combustion system control unit 1 feeds the following measurement data to an abnormality degree calculating circuit 2.

Spark detection time (measurement data a).

Frequency of abnormalities occurring in the spark detection time (the number of times the spark detection time exceeded a predetermined limit value during a specified period of time in the past).

Ignition transformer primary current (measurement data b).

Flame current produced with spark check timing (measurement data c).

Frequency of abnormalities occurring in the flame current applied with spark check timing (the number of times the deviation of the flame current from the normal value exceeded a predetermined limit value during a specified period in the past).

Flame current produced with ignition trial timing (measurement data d).

An abnormality degree calculating circuit 2 has k threshold values T1 to Tk for each of the items of measurement data mentioned above, and calculates an abnormality degree A representing the degree of abnormality of each measurement data item D from the mathematical expression 1 given below. The threshold values for the items of measurement data have already been stored in an abnormality degree threshold value memory 3 connected to the abnormality degree calculating circuit 2.

(Mathematical Expression 1)

$$\text{When } D < T1, \quad A = 0 \text{ (normal)}$$

$$\text{When } T1 \le D < T2, \quad A = 1$$

$$\text{When } T2 \le D < T3, \quad A = 2$$

-continued $$\vdots \qquad \vdots$$

$$\text{When } Tk - 1 \le D < Tk, \quad A = k - 1$$

$$\text{When } Tk \le D, \quad A = k$$

The abnormality degrees A of the respective items of measurement data thus obtained are fed to a binary conversion circuit 4, in which the measurement data is interpreted as being normal when the abnormality degree A=0, or as being abnormal when the abnormality degree A≧1. Thus, the measurement data is converted to binary data representing "normal" or "abnormal". The result is fed to a condition judging circuit 5. This circuit 5 discriminates the types of states of failures by the judgement of conditions to be described below. The result of discrimination and the abnormality degrees A obtained by the calculating circuit 2 are fed to a diagnosis data calculating circuit 6. A diagnosis knowledge base 7 is connected to the condition judging circuit 5 and the diagnosis data calculating circuit 6.

The following six conditions are set in the diagnosis knowledge base 7 for discriminating the types of states of failures as shown in FIG. 7.

Condition 1: when the measurement data a is abnormal.

Condition 2: when the measurement data b is abnormal.

Condition 3: when the measurement data c is normal.

Condition 4: when the measurement data b is abnormal, and the measurement data c is abnormal, and the measurement data d is normal.

Condition 5: when the measurement data b is abnormal, and the measurement data c is abnormal, and the measurement data d is abnormal.

Condition 6: when the measurement data b is normal, and the measurement data c is abnormal.

The condition judging circuit 5 judges to which condition the binary data obtained by the binary conversion circuit 4 corresponds, and feeds the result to the diagnosis data calculating circuit 6. Usually the binary data corresponds not to one condition but to a plurality of conditions.

As shown in FIG. 7, the diagnosis knowledge base 7 has further specified therein, for every condition, an item or different items of index data to be considered in diagnosis, and the strength W of connection between the index data and a plurality of causes of failures.

More specifically, specified for the condition 1 are the following five items of index data.

(1-1) Abnormality degree of the measurement data a (1-2) Abnormality degree of abnormality occurrence frequency of the measurement data a (1-3) Abnormality degree of the measurement data b (1-4) Abnormality degree of the measurement data c (1-5) Abnormality degree of abnormality occurrence frequency of the measurement data c The following three items of index data are specified for the condition 2.

(2-1) Abnormality degree of the measurement data b (2-2) Abnormality degree of the measurement data c (2-3) Abnormality degree of abnormality occurrence frequency of the measurement data c The following index data is specified for the condition 3.

(3-1) Abnormality degree of the measurement data b

The following two items of index data are specified for the condition 4.

(4-1) Abnormality degree of the measurement data b (4-2) Abnormality degree of the measurement data c The following two items of index data are specified for the condition 5.

(5-1) Abnormality degree of the measurement data b (5-2) Abnormality degree of the measurement data c The following two items of index data are specified for the condition 6.

(6-1) Abnormality degree of the measurement data c (6-2) Abnormality degree of abnormality occurrence frequency of the measurement data c Incidentally, the conditions and connection strengths given in FIG. 7 are obtained by gathering knowledge from skilled maintenance inspectors through interviews and organizing the knowledge in order.

The diagnosis data calculating circuit 6 reads connection strengths concerning the items of index data from the diagnosis knowledge base 7 and accepts the abnormality degrees as to the index data available from the abnormality degree calculating circuit 2.

Concerning a condition N, suppose the abnormality degree of index data m determined under the condition is $A_{N-m}$, and the strength of connection between a predicted cause i of failure and the index data m is $W_{i,N-m}$, the diagnosis data $F_i$ as to the cause i can be calculated generally from the following mathematical expression 2.

(Mathematical Expression 2)

$$F_{i=\Sigma N \Sigma m}\ (A_{N-m} \times W_{i,N-m})$$

wherein ΣN represents a sum as to N, and $\Sigma_m$ represents a sum as to m. When the condition N is not established, $W_{i,N-m}=0$.

The diagnosis data F thus obtained is output from an output unit 8. It can be inferred that when the diagnosis data Fi is relatively greater, higher is the probability that the cause i of failure will be the true cause of the failure in the ignition transformer line.

Besides using the foregoing method of calculating the diagnosis data by summing as represented by the mathematical expression 2, it is also possible to use the maximum value of the product $(A_{N-m} \times W_{i,N-m})$ as to each cause of failure.

In calculating diagnosis data from the expression 2 above, it is also possible to carry out such calculation as to suppress the diagnosis data to a specified value if the result of calculation is greater than the specified value.

Spark Rod Line

The combustion system control unit 1 feeds the following measurement data to the abnormality degree calculating circuit 2.

Spark detection time (measurement data a).

Frequency of abnormalities occurring in the spark detection time.

Ignition transformer primary current (measurement data b).

Flame current produced with spark check timing (measurement data c).

Frequency of abnormalities occurring in the flame current produced with spark check timing.

Flame current produced with ignition trial timing (measurement data d).

Ignition time lag (measurement data e) Frequency of abnormalities occurring in the ignition time lag (the number of times the ignition time lag exceeded a predetermined limit value during a specified period of time in the past).

Flame current produced with pilot only timing (measurement data f).

The abnormality degree calculating circuit 2 similarly has threshold values T1 to Tk for each of the items of measurement data mentioned above, and calculates an abnormality degree A representing the degree of abnormality of each measurement data item D from the mathematical expression 1.

The abnormality degrees A of the respective items of measurement data thus obtained are fed to the binary conversion circuit 4, in which the measurement data is converted to binary data representing "normal" or "abnormal". The result is fed to the condition judging circuit 5.

Figure 8:
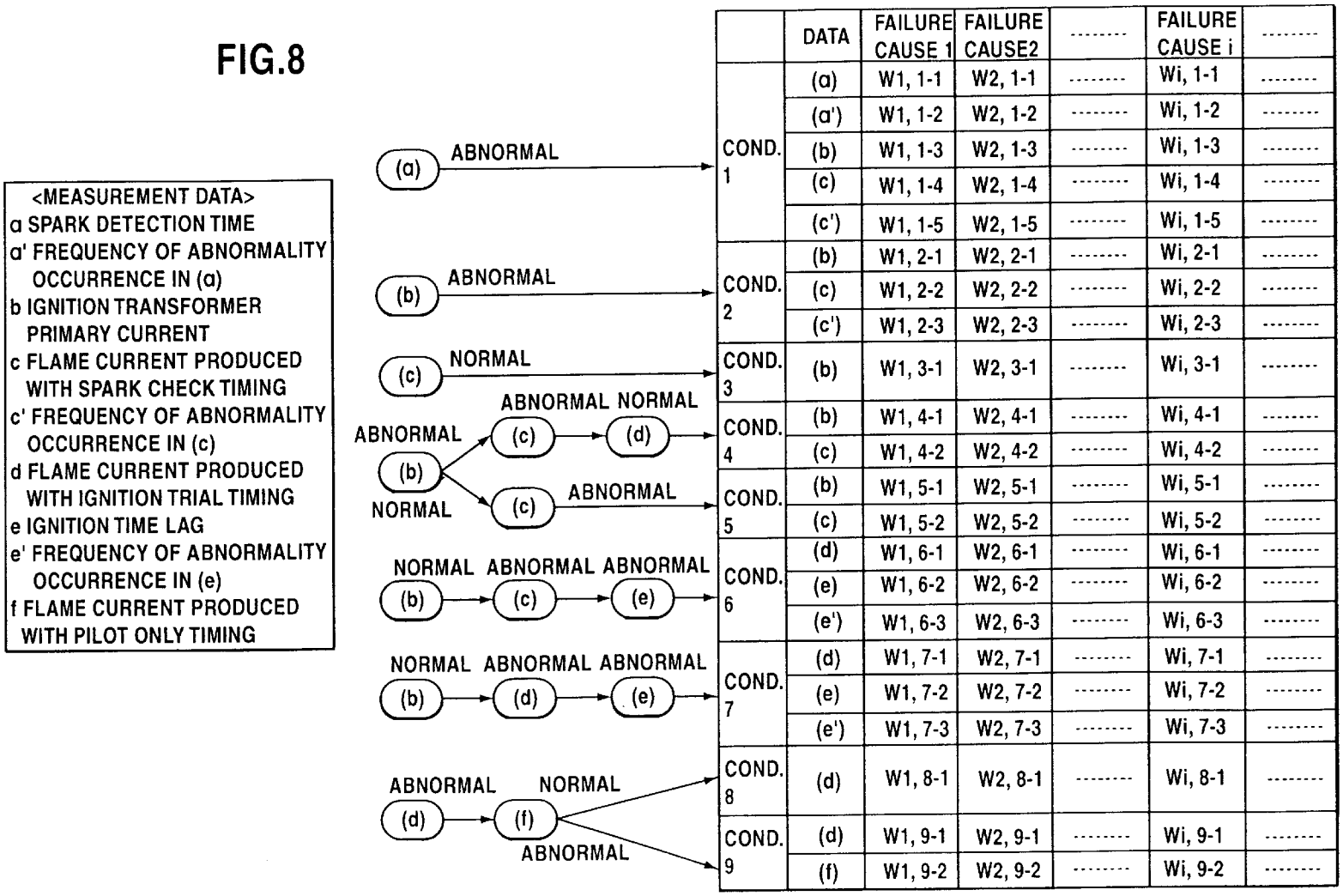
FIG. 8 is a diagram showing the same as to a spark rod line.

The following nine conditions are set in the diagnosis knowledge base 7 for discriminating the types of states of failures as shown in FIG. 8.

Condition 1: when the measurement data a is abnormal.

Condition 2: when the measurement data b is abnormal.

Condition 3: when the measurement data c is normal.

Condition 4: when the measurement data b is abnormal, and the measurement data c is abnormal, and the measurement data d is normal.

Condition 5: when the measurement data b is normal, and the measurement data c is abnormal.

Condition 6: when the measurement data b is normal, and the measurement data c is abnormal, and the measurement data e is abnormal.

Condition 7: when the measurement data b is normal, and the measurement data d is abnormal, and the measurement data e is abnormal.

Condition 8: when the measurement data d is abnormal, and the measurement data f is normal.

Condition 9: when the measurement data d is abnormal, and the measurement data f is abnormal.

The condition judging circuit 5 judges to which condition the binary data obtained by the binary conversion circuit 4 corresponds, and feeds the result to the diagnosis data calculating circuit 6.

As shown in FIG. 8, the diagnosis knowledge base 7 has further specified therein, for every condition, an item or different items of index data to be considered in diagnosis, and the strength W of connection between the index data and a plurality of causes of failures.

More specifically, specified for the condition 1 are the following five items of index data.

(1-1) Abnormality degree of the measurement data a (1-2) Abnormality degree of abnormality occurrence frequency of the measurement data a (1-3) Abnormality degree of the measurement data b (1-4) Abnormality degree of the measurement data c (1-5) Abnormality degree of abnormality occurrence frequency of the measurement data c The following three items of index data are specified for the condition 2.

(2-1) Abnormality degree of the measurement data b (2-2) Abnormality degree of the measurement data c (2-3) Abnormality degree of abnormality occurrence frequency of the measurement data c The following index data is specified for the condition 3.

(3-1) Abnormality degree of the measurement data b

The following two items of index data are specified for the condition 4.

(4-1) Abnormality degree of the measurement data b (4-2) Abnormality degree of the measurement data c The following two items of index data are specified for the condition 5.

(5-1) Abnormality degree of the measurement data c (5-2) Abnormality degree of abnormality occurrence frequency of the measurement data c The following three items of index data are specified for the condition 6.

(6-1) Abnormality degree of the measurement data d (6-2) Abnormality degree of the measurement data e (6-3) Abnormality degree of abnormality occurrence frequency of the measurement data e The following three items of index data are specified for the condition 7.

(7-1) Abnormality degree of the measurement data d (7-2) Abnormality degree of the measurement data e (7-3) Abnormality degree of abnormality occurrence frequency of the measurement data e The following index data is specified for the condition 8.

(8-1) Abnormality degree of the measurement data d

The following two items of index data are specified for the condition 9.

(9-1) Abnormality of the measurement data d (9-2) Abnormality of the measurement data f The diagnosis data calculating circuit 6 similarly reads connection strengths concerning the items of index data from the diagnosis knowledge base 7, accepts the abnormality degrees as to the index data available from the abnormality degree calculating circuit 2 and calculates diagnosis data $F_i$ concerning the cause i from the foregoing mathematical expression 2. The diagnosis data F thus obtained is output from the output unit 8.

Pilot Burner Line

The combustion system control unit 1 feeds the following measurement data to the abnormality degree calculating circuit 2.

Ignition transformer primary current (measurement data a).

Flame current produced with spark check timing (measurement data b).

Flame current produced with ignition trial timing (measurement data c).

Ignition time lag (measurement data d)

Frequency of abnormalities occurring in the ignition time lag

Flame current produced with pilot only timing (measurement data e).

Frame current in the first 1.5-second period of main trial timing (measurement data f)

The abnormality degree calculating circuit 2 similarly has threshold values T1 to Tk for each of the items of measurement data mentioned above, and calculates an abnormality degree A representing the degree of abnormality of each measurement data item D from the mathematical expression 1.

The abnormality degrees A of the respective items of measurement data thus obtained are fed to the binary conversion circuit 4, in which the measurement data is converted to binary data representing "normal" or "abnormal". The result is fed to the condition judging circuit 5.

Figure 9:
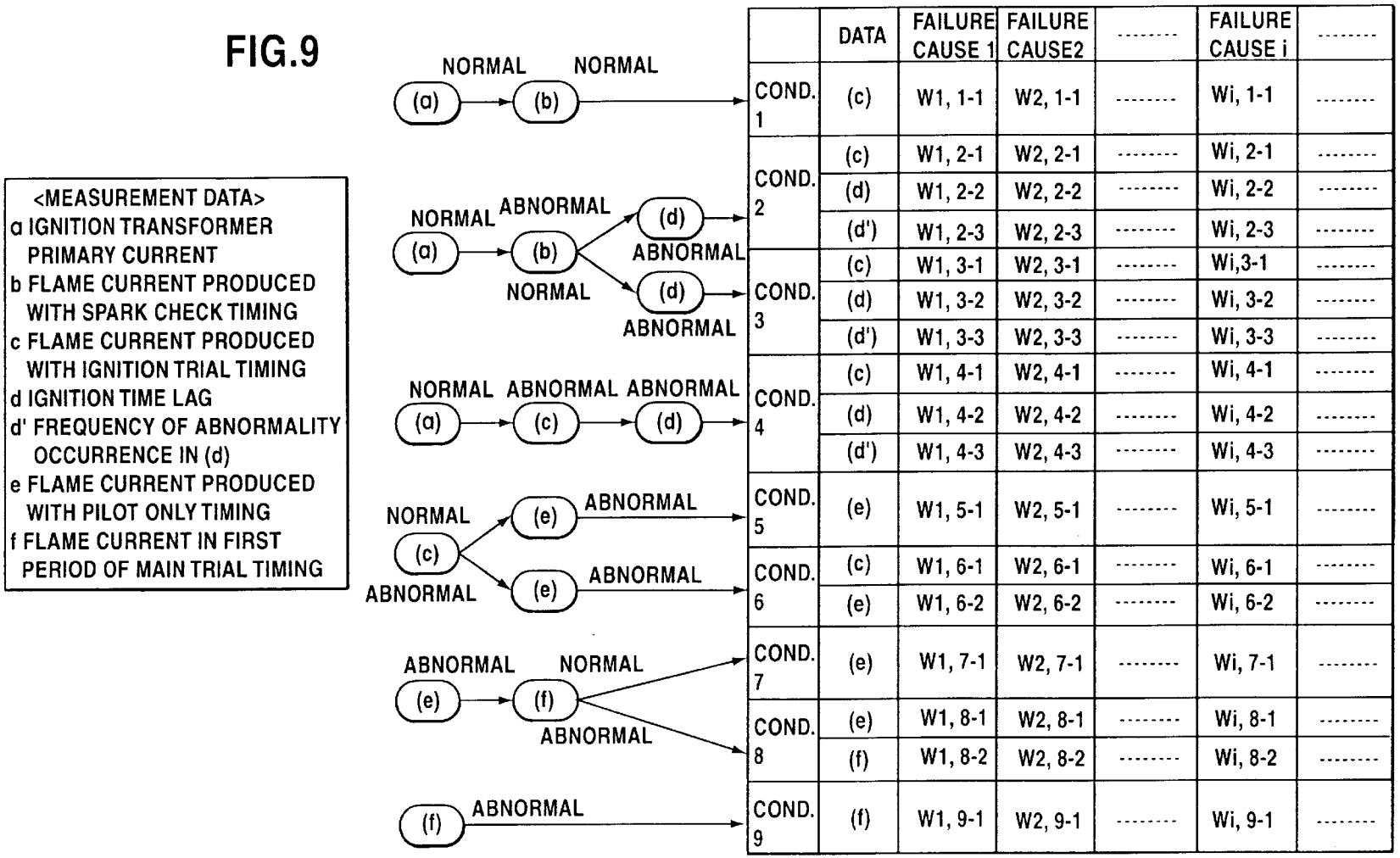
FIG. 9 is a diagram showing the same as to a pilot burner line.

The following nine conditions are set in the diagnosis knowledge base 7 for discriminating the types of states of failures as shown in FIG. 9.

Condition 1: when the measurement data a is normal, and the measurement data b is normal.

Condition 2: when the measurement data a is normal, and the measurement data b is abnormal, and the measurement data d is abnormal.

Condition 3: when the measurement data a is normal, and the measurement data b is normal, and the measurement data d is abnormal.

Condition 4: when the measurement data a is normal, and the measurement data c is abnormal, and the measurement data d is abnormal.

Condition 5: when the measurement data c is normal, and the measurement data e is abnormal.

Condition 6: when the measurement data c is abnormal, and the measurement data e is abnormal.

Condition 7: when the measurement data e is abnormal, and the measurement data f is normal.

Condition 8: when the measurement data e is abnormal, and the measurement data f is abnormal.

Condition 9: when the measurement data f is abnormal.

The condition judging circuit 5 judges to which condition the binary data obtained by the binary conversion circuit 4 corresponds, and feeds the result to the diagnosis data calculating circuit 6.

As shown in FIG. 9, the diagnosis knowledge base 7 has further specified therein, for every condition, an item or different items of index data to be considered in diagnosis, and the strength W of connection between the index data and a plurality of causes of failures.

More specifically, specified for the condition 1 is the following index data.

(1-1) Abnormality degree of the measurement data c

The following three items of index data are specified for the condition 2.

(2-1) Abnormality degree of the measurement data c (2-2) Abnormality degree of the measurement data d (2-3) Abnormality degree of abnormality occurrence frequency of the measurement data d The following three items of index data are specified for the condition 3.

(3-1) Abnormality degree of the measurement data c (3-2) Abnormality degree of the measurement data d (3-3) Abnormality degree of abnormality occurrence frequency of the measurement data d The following three items of index data are specified for the condition 4.

(4-1) Abnormality degree of the measurement data c (4-2) Abnormality degree of the measurement data d (4-3) Abnormality degree of abnormality occurrence frequency of the measurement data d The following index data is specified for the condition 5.

(5-1) Abnormality degree of the measurement data e

The following two items of index data are specified for the condition 6.

(6-1) Abnormality degree of the measurement data c (6-2) Abnormality degree of the measurement data e The following index data is specified for the condition 7.

(7-1) Abnormality degree of the measurement data e

The following two items of index data are specified for the condition 8.

(8-1) Abnormality degree of the measurement data e (8-2) Abnormality degree of the measurement data f The following index data is specified for the condition 9.

(9-1) Abnormality of the measurement data f

The strength W of connection between the items of index data and a plurality of causes of failures is also defined.

The diagnosis data calculating circuit 6 similarly reads connections strengths concerning the items of index data from the diagnosis knowledge base 7, accepts the abnormality degrees as to the index data available from the abnormality degree calculating circuit 2 and calculates diagnosis data $F_i$ as to causes i of failures from the foregoing methematical expression 2. The diagnosis data F thus obtained is output from the output unit 8.

Main Burner Line

The combustion system control unit 1 feeds the following measurement data to the abnormality degree calculating circuit 2.

Flame current produced with pilot only timing (measurement data a).

Frame current in the first 1.5-second period of main trial timing (measurement data b)

Frame current in the following 7.5-second period of main trial timing (measurement data c)

Frame current produced with main stabilizing timing (measurement data d)

The abnormality degree calculating circuit 2 similarly has threshold values T1 to Tk for each of the items of measurement data mentioned above, and calculates an abnormality degree A representing the degree of abnormality of each measurement data item D from the mathematical expression 1.

The abnormality degrees A of the respective items of measurement data thus obtained are fed to the binary conversion circuit 4, in which the measurement data is converted to binary data representing "normal" or "abnormal". The result is fed to the condition judging circuit 5.

Figure 10:
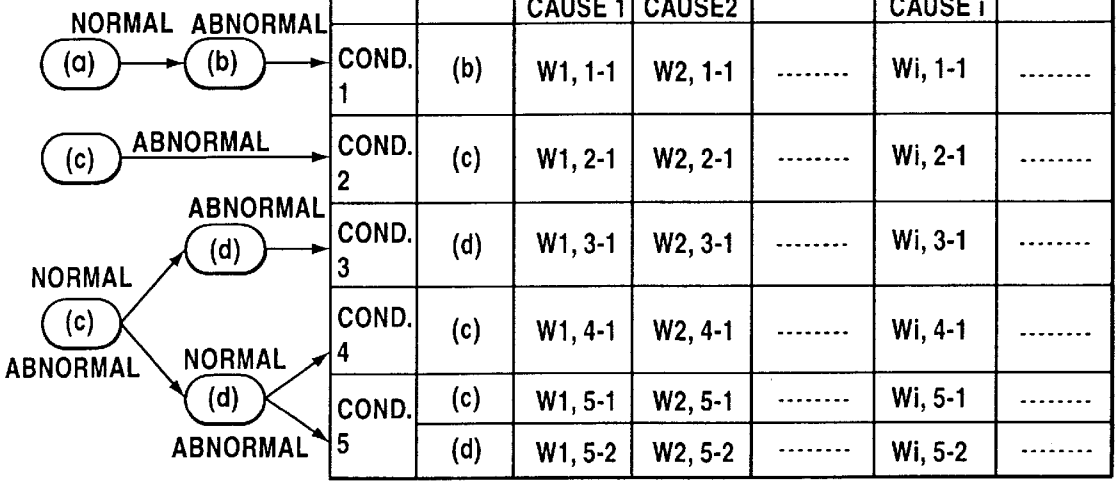
FIG. 10 is a diagram showing the same as to a main burner line.

The following five conditions are set in the diagnosis knowledge base 7 for discriminating the types of states of failures as shown in FIG. 10.

Condition 1: when the measurement data a is normal, and the measurement data b is abnormal.

Condition 2: when the measurement data c is abnormal.

Condition 3: when the measurement data c is normal, and the measurement data d is abnormal.

Condition 4: when the measurement data c is abnormal, and the measurement data d is normal.

Condition 5: when the measurement data c is abnormal, and the measurement data d is abnormal.

The condition judging circuit 5 judges to which condition the binary data obtained by the binary conversion circuit 4 corresponds, and feeds the result to the diagnosis data calculating circuit 6.

As shown in FIG. 10, the diagnosis knowledge base 7 has further specified therein, for every condition, an item or different items of index data to be considered in diagnosis, and the strength W of connection between the index data and a plurality of causes of failures.

More specifically, specified for the condition 1 is the following index data.

(1-1) Abnormality degree of the measurement data b

The following index data is specified for the condition 2.

(2-1) Abnormality degree of the measurement data c

The following index data is specified for the condition 3.

(3-1) Abnormality degree of the measurement data d

The following index data is specified for the condition 4.

(4-1) Abnormality degree of the measurement data c

The following two items of index data are specified for the condition 5.

(5-1) Abnormality degree of the measurement data c (5-2) Abnormality degree of the measurement data d The strength W of connection between the items of index data and a plurality of causes of failures is also defined.

The diagnosis data calculating circuit 6 similarly reads connection strengths concerning the items of index data from the diagnosis knowledge base 7, accepts the abnormality degrees as to the index data available from the abnormality degree calculating circuit 2 and calculates diagnosis data $F_i$ as to causes i of failures from the mathematical expression given above. The diagnosis data F thus obtained is output from the output unit 8.

The following is taken into consideration in setting the conditions and strength of connection shown in FIGS. 7 to 10.

Concerning the condition 1 of the ignition transformer line and the condition 1 of the spark rod line, a delay in the spark detection time, if occurring, is attributable not to the pilot burner line or the main burner line but to the ignition transformer line or the spark rod line only, so that an abnormal lag in the spark detection time is specified as a condition in diagnosing failures in the ignition transformer line and the spark rod line. This condition is used in combination with the measurement data (ignition transformer primary current, frame current with spark check timing) usable in checking the transformer line and spark rod line to locate the cause of failure in the rod line, especially in the transformer line.

Concerning the condition 2 of the ignition transformer line and the condition 2 of the spark rod line, a fault in the transformer primary current, if occurring, is attributable to the transformer line or the rod line only, and not to the pilot burner line or the main burner line. Accordingly, an abnormal transformer current is specified as a condition for use in checking the ignition transformer line and the spark rod line. When a fault occurred in the flame current produced with spark check timing under this condition, the cause is to be traced to the transformer line, especially to the spark rod line.

Concerning the condition 3 for the ignition transformer line and the condition 3 for the spark rod line, a fault in the ignition transformer primary current, if occurring, is attributable not to the pilot or main burner line but to the transformer line or the spark rod line only. In checking the transformer line and the spark rod line based on the abnormality of the transformer primary current, therefore, the transformer line is inspected especially although the rod line is also checked, on condition that the flame current produced with spark check timing is normal.

Concerning the condition 1 for the pilot burner line, the condition that the transformer line and the rod line are normal is specified if the transformer primary current and the flame current flowing with spark check timing are normal. When a fault occurred in the flame current flowing with ignition trial timing under this condition, the cause is to be traced especially to the pilot burner line.

Concerning the condition 4 for the ignition transformer line and the condition 4 for the spark rod line, the pilot burner ignites normally when the abnormality due to a failure in the transformer line or the spark rod line is small, so that the premise that the flame current flowing with ignition trial timing is normal is provided. The cause is to be identified further when the transformer primary current and the flame current produced with spark check timing are normal.

Concerning the condition 5 for the ignition transformer line, a fault is likely to occur in the transformer primary current, flame current produced with spark check timing and flame current flowing with ignition trial timing as a state of failure in the transformer line. The cause is to be traced to the transformer line in the light of these conditions.

Concerning the condition 6 for the transformer line and the condition 5 for the spark rod line, a fault occurring in the flame current flowing with the spark check timing, with normal primary current flowing through the transformer, is generally attributable to the rod line, so that these conditions are to be used for tracing the cause.

Concerning the condition 6 for the spark rod line and the conditions 2 and 3 for the pilot burner line, a fault in the ignition time lag when the transformer primary current is normal is attributable not to the transformer line but to the spark rod line or the pilot burner line, so that these conditions are specified. If a fault occurred in the flame current produced with spark check timing, the cause is traced under these conditions predominantly to the pilot burner line although the spark rod line is also suspected, whereas the cause is to be traced to the pilot burner line in the case where the flame current produced with spark check timing is normal.

Concerning the condition 7 for the spark rod line and the condition 4 for the pilot burner line, the spark rod line or the pilot burner line is responsible for a fault occurring in the flame current produced with ignition trial timing and ignition time lag. To show this evidently, a condition is specified to the effect that the transformer is normal, that is, the transformer primary current is normal.

The conditions 8 and 9 for the spark rod. line and the conditions 5 and 6 for the pilot burner line are diagnosis conditions specified with attention directed to the flame current produced with ignition trial timing and the flame current produced with pilot only timing. The combination of these currents in normal/abnormal state is used for tracing causes of failures to the rod line or pilot burner line.

The conditions 7 and 8 for the pilot burner line and the condition 1 for the main burner line are diagnosis conditions set with attention focused on the flame current with pilot only timing and the flame current during the first period of main trial timing. The combination of the currents in normal/abnormal state is used for tracing causes of failures to the spark rod line or pilot burner line.

The condition 9 for the pilot burner line and the condition 2 for the main burner line are diagnosis conditions set with attention directed to the flame current produced during the first period of main trial timing and that during the following period thereof. The combination of the currents in normal/abnormal state is used for tracing causes of failures to the pilot burner line or main burner line.

Further the conditions 3, 4 and 5 for the main burner line are specified with attention directed to the flame current during the following period of main trial timing and the flame current produced with the main stabilizing timing. The combination of the currents in normal/abnormal state is used for tracing causes of failures to the pilot burner line or main burner line.

The failure diagnosing apparatus for the respective ignition transformer line, spark rod line, pilot burner line and main burner line produce, for each of presumed causes of failures, diagnosis data representing the magnitude of the probability that the cause will be the true cause, consequently enabling even inspectors of small experience to readily diagnose failures with such items of diagnosis data. The diagnosis knowledge base 7 for use in diagnosing failures is constructed of the knowledge of skilled inspectors as gathered and organized in order and therefore affords diagnosis results with high reliability.

In diagnosing failures with use of the diagnosis knowledge base 7, types of failure states characterized by the operation sequence of the combustion system are first discriminated, and the relation between causes of failures and symptoms is then substantiated for every type to calculate diagnosis data, with the result even when one cause of failure as entangled in the sequence influences many judging indexes, the diagnosis data available is highly accurate.

The foregoing description of the embodiments is intended to illustrate the present invention and should not be construed as limiting the invention defined in the appended claims or reducing the scope thereof. The construction of the apparatus of the invention is not limited to those of the embodiments but can of course be modified variously without departing from the spirit of the invention as set forth in the claims.

For example, the combustion system as described above is divided into four lines, i.e., the ignition transformer line, spark rod line, pilot burner line and main burner line, which are each provided with the failure diagnosing apparatus, whereas the combustion system in its entirety can be inspected for diagnosis. In this case, the conditions and the strengths of connection shown in FIGS. 7 to 10 are used as given.

What is claimed is:

1. In a combustion system wherein a fuel jetted out from a burner is ignited and caused to produce flames in a predetermined sequence, an apparatus for diagnosing failures in the combustion system in its entirety or in some of component devices of the combustion system, the failure diagnosing apparatus comprising:

means for measuring different items of measurement data representing the behavior of each component device of the combustion system during the operation of the system in the predetermined sequence, a diagnosis knowledge base having stored therein as knowledge data the causal relation of different kinds of failures to causes which failures can occur in one or a plurality of component devices to be inspected for diagnosis, in connection with the different items of measurement data to be obtained from the measuring means, and knowledge base drive means for driving the diagnosis knowledge base based on the measurement data obtained from the measuring means and deriving diagnosis data as to the causes of failures.

2. A failure diagnosing apparatus as defined in claim 1 wherein the knowledge base drive means comprises data processing means for preparing different items of index data serving as judging indexes in diagnosing failures, based on the measurement data obtained from the measuring means, and the diagnosis knowledge base comprises a condition knowledge portion having defined therein conditions for discriminating types of states of failures based on the index data, the conditions being classified for the respective types, and a connection strength knowledge portion having defined therein the strength of connection between one item or different items of index data and the causes of a plurality of failures, for every failure type, the knowledge base drive means being operable to discriminate the types of failure states from the index data with reference to the condition knowledge portion and to thereafter calculate, from the index data for each type discriminated, diagnosis data representing the probability that the cause of the failure will be the true cause with reference to the connection strength knowledge portion.

3. In a combustion system which is installed in a regenerator of an absorption chiller and wherein a fuel jetted out from a burner is ignited and caused to produce flames in a predetermined sequence, an apparatus for diagnosing failures in the combustion system in its entirety or in some of component devices of the combustion system, the failure diagnosing apparatus comprising:

means for measuring different items of measurement data representing the behavior of each component device of the combustion system during the operation of the system in the predetermined sequence, a diagnosis knowledge base having stored therein as knowledge data the causal relation of different kinds of failures to causes which failures can occur in one or a plurality of component devices to be inspected for diagnosis, in connection with the different items of measurement data to be obtained from the measuring means, and knowledge base drive means for driving the diagnosis knowledge base based on the measurement data obtained from the measuring means and deriving diagnosis data as to the causes of failures.

4. A failure diagnosing apparatus as defined in claim 3 wherein the knowledge base drive means comprises data processing means for preparing different items of index data serving as judging indexes in diagnosing failures, based on the measurement data obtained from the measuring means, and the diagnosis knowledge base comprises a condition knowledge portion having defined therein conditions for discriminating types of states of failures based on the index data, the conditions being classified for the respective types, and a connection strength knowledge portion having defined therein the strength of connection between one item or different items of index data and the causes of a plurality of failures, for every failure type, the knowledge base drive means being operable to discriminate the types of failure states from the index data with reference to the condition knowledge portion and to thereafter calculate, from the index data for each type discriminated, diagnosis data representing the probability that the cause of the failure will be the true cause with reference to the connection strength knowledge portion.

5. A failure diagnosing apparatus as defined in claim 4 wherein the combustion system to be inspected for diagnosis comprises a main burner line including a main burner, a pilot burner line including a pilot burner for igniting the main burner, a spark rod line including a spark rod for igniting the pilot burner, and an ignition transformer line including an ignition transformer for driving the spark rod, and has a flame sensor for detecting flames from the main burner or the pilot burner and sparks from the spark rod.

6. A failure diagnosing apparatus as defined in claim 5 which is adapted to diagnose failures in the ignition transformer line and wherein the measurement data includes time after the application of voltage to the ignition transformer and until a spark from the spark rod is detected (measurement data a), current flowing through a primary winding of the ignition transformer (measurement data b), flame current produced by the flame sensor when the spark rod line is caused to generate a spark with the supply of fuel to the pilot burner shut off (measurement data c), and flame current produced by the flame sensor when the spark rod line is caused to generate a spark with the fuel supplied to the pilot burner (measurement data d), and the condition knowledge portion of the diagnosis knowledge base has set therein the six conditions of:

condition 1: when the measurement data a is abnormal, condition 2: when the measurement data b is abnormal, condition 3: when the measurement data c is normal, condition 4: when the measurement data b is abnormal, and the measurement data c is abnormal, and the measurement data d is normal, condition 5: when the measurement data b is abnormal, and the measurement data c is abnormal, and the measurement data d is abnormal, and condition 6: when the measurement data b is normal, and the measurement data c is abnormal, as the conditions for discriminating the types of failure states.

7. A failure diagnosing apparatus as defined in claim 6 wherein the connection strength knowledge portion has specified for the condition 1 the abnormality degree of the measurement date a, abnormality degree of abnormality occurrence frequency of the measurement data a, abnormality degree of the measurement data b, abnormality degree of the measurement data c and abnormality degree of abnormality occurrence frequency of the measurement data c as index data to define the strength of connection between the index data and a plurality of causes of failures, for the condition 2 the abnormality degree of the measurement data b, abnormality degree of the measurement data c and abnormality degree of abnormality occurrence frequency of the measurement c as index data to define the strength of connection between the index data and a plurality of causes of failures, for the condition 3 the abnormality degree of the measurement data b as index data to define the strength of connection between the index data and a plurality of causes of failures, for the condition 4 the abnormality degree of the measurement data b and abnormality degree of the measurement data c as index data to define the strength of connection between the index data and a plurality of causes of failures, for the condition 5 the abnormality degree of the measurement data b and abnormality degree of the measurement data c as index data to define the strength of connection between the index data and a plurality of causes of failures, and for the condition 6 the abnormality degree of the measurement data c and abnormality degree of abnormality occurrence frequency of the measurement data c as index data to define the strength of connection between the index data and a plurality of causes of failures.

8. A failure diagnosing apparatus as defined in claim 5 which is adapted to diagnose failures in the spark rod line and wherein the measurement data includes time after the application of voltage to the ignition transformer and until a spark from the spark rod is detected (measurement data a), current flowing through a primary winding of the ignition transformer (measurement data b), flame current produced by the flame sensor when the spark rod line is caused to generate a spark with the supply of fuel to the pilot burner shut off (measurement data c), flame current produced by the flame sensor when the spark rod line is caused to generate a spark with the fuel supplied to the pilot burner (measurement data d), a time lag after the supply of fuel to the pilot burner and until the pilot burner ignites (measurement data e) and flame current produced from the flame sensor with the pilot burner only ignited (measurement data f), and the condition knowledge portion of the diagnosis knowledge base has set therein the nine conditions of:

condition 1: when the measurement data a is abnormal, condition 2: when the measurement data b is abnormal, condition 3: when the measurement data c is normal, condition 4: when the measurement data b is abnormal, and the measurement data c is abnormal, and the measurement data d is normal, condition 5: when the measurement data b is normal, and the measurement data c is abnormal, condition 6: when the measurement data b is normal, and the measurement data c is abnormal, and the measurement data e is abnormal, condition 7: when the measurement data b is normal, and the measurement data d is abnormal, and the measurement data e is abnormal, condition 8: when the measurement data d is abnormal, and the measurement data f is normal, and condition 9: when the measurement data d is abnormal, and the measurement data f is abnormal, as the conditions for discriminating the types of failure states.

9. A failure diagnosing apparatus as defined in claim 8 wherein the connection strength knowledge portion has specified for the condition 1 the abnormality degree of the measurement date a, abnormality degree of abnormality occurrence frequency of the measurement data a, abnormality degree of the measurement data b, abnormality degree of the measurement data c and abnormality degree of abnormality occurrence frequency of the measurement data c as index data to define the strength of connection between the index data and a plurality of causes of failures, for the condition 2 the abnormality degree of the measurement data b , abnormality degree of the measurement data c and abnormality degree of abnormality occurrence frequency of the measurement data c as index data to define the strength of connection between the index data and a plurality of causes of failures, for the condition 3 the abnormality degree of the measurement data b as index data to define the strength of connection between the index data and a plurality of causes of failures, for the condition 4 the abnormality degree of the measurement data b and abnormality degree of the measurement data c as index data to define the strength of connection between the index data and a plurality of causes of failures, for the condition 5 the abnormality degree of the measurement data c and abnormality degree of abnormality occurrence frequency of the measurement data c as index data to define the strength of connection between the index data and a plurality of causes of failures, for the condition 6 the abnormality degree of the measurement data d, abnormality degree of the measurement data e and abnormality degree of abnormality occurrence frequency of the measurement data e as index data to define the strength of connection between the index data and a plurality of causes of failures, for condition 7 the abnormality degree of the measurement data d, abnormality degree of the measurement data e and abnormality degree of abnormality occurrence frequency of the measurement data e as index data to define the strength of connection between the index data and a plurality of causes of failures, for condition 8 the abnormality degree of the measurement data d as index data to define the strength of connection between the index data and a plurality of causes of failures, and for condition 9 the abnormality degree of the measurement data d and abnormality degree of the measurement data f as index data to define the strength of connection between the index data and a plurality of causes of failures.

10. A failure diagnosing apparatus as defined in claim 5 which is adapted to diagnose failures in the pilot burner line and wherein the measurement data includes current flowing through a primary winding of the ignition transformer (measurement data a), flame current produced by the flame sensor when the spark rod line is caused to generate a spark with the supply of fuel to the pilot burner shut off (measurement data b), flame current produced by the flame sensor when the spark rod line is caused to generate a spark with the fuel supplied to the pilot burner (measurement data c), a time lag after the supply of fuel to the pilot burner and until the pilot burner ignites (measurement data d) flame current produced from the flame sensor with the pilot burner only ignited (measurement data e) and flame current produced from the flame sensor during the first portion of the period after the start of supply of fuel to the main burner and until the fuel supply to the pilot burner is discontinued (measurement data f), and the condition knowledge portion of the diagnosis knowledge base has set therein the nine conditions of:

condition 1: when the measurement data a is normal, and the measurement data b is normal, condition 2: when the measurement data a is normal, and the measurement data b is abnormal, and the measurement data d is abnormal, condition 3: when the measurement data a is normal, and the measurement data b is normal, and the measurement data d is abnormal, condition 4: when the measurement data a is normal, and the measurement data c is abnormal, and the measurement data d is abnormal, condition 5: when the measurement data c is normal, and the measurement data e is abnormal, condition 6: when the measurement data c is abnormal, and the measurement data e is abnormal, condition 7: when the measurement data e is abnormal, and the measurement data f is normal, condition 8: when the measurement data e is abnormal, and the measurement data f is abnormal, and condition 9: when the measurement data f is abnormal, as the conditions for discriminating the types of failure states.

11. A failure diagnosing apparatus as defined in claim 10 wherein the connection strength knowledge portion has specified for the condition 1 the abnormality degree of the measurement date c as index data to define the strength of connection between the index data and a plurality of causes of failures, for the condition 2 the abnormality degree of the measurement data c, abnormality degree of the measurement data d and abnormality degree of abnormality occurrence frequency of the measurement data d as index data to define the strength of connection between the index data and a plurality of causes of failures, for the condition 3 the abnormality degree of the measurement data c, abnormality degree of the measurement data d and abnormality degree of abnormality occurrence frequency of the measurement data d as index data to define the strength of connection between the index data and a plurality of causes of failures, for the condition 4 the abnormality degree of the measurement data c, abnormality degree of the measurement data d and abnormality degree of abnormality occurrence frequency of the measurement data d as index data to define the strength of connection between the index data and a plurality of causes of failures, for the condition 5 the abnormality degree of the measurement data e as index data to define the strength of connection between the index data and a plurality of causes of failures, for the condition 6 the abnormality degree of the measurement data c and abnormality degree of the measurement data e as index data to define the strength of connection between the index data and a plurality of causes of failures, for condition 7 the abnormality degree of the measurement data e as index data to define the strength of connection between the index data and a plurality of causes of failures, for condition 8 the abnormality degree of the measurement data e and abnormality degree of the measurement data f as index data to define the strength of connection between the index data and a plurality of causes of failures, and for condition 9 the abnormality degree of the measurement data f as index data to define the strength of connection between the index data and a plurality of causes of failures.

12. A failure diagnosing apparatus as defined in claim 5 which is adapted to diagnose failures in the main burner line and wherein the measurement data includes flame current produced from the flame sensor with the pilot burner only ignited (measurement data a), flame current produced from the flame sensor during the first portion of the period after the start of supply of fuel to the main burner and until the fuel supply to the pilot burner is discontinued (measurement data b), flame current produced from the flame sensor during the following portion of said period (measurement data c) and flame current produced from the flame sensor for a definite period after the fuel supply to the pilot burner is discontinued and until the fuel supply to the main burner is controlled by an external circuit upon a change-over (measurement data d), and the condition knowledge portion of the diagnosis knowledge base has set therein the five conditions of:

condition 1: when the measurement data a is normal, and the measurement data b is abnormal, condition 2: when the measurement data c is abnormal, condition 3: when the measurement data c is normal, and the measurement data d is abnormal, condition 4: when the measurement data c is abnormal, and the measurement data d is normal, and condition 5: when the measurement data c is abnormal, and the measurement data d is abnormal as the conditions for discriminating the types of failure states.

13. A failure diagnosing apparatus as defined in claim 12 wherein the connection strength knowledge portion has specified for the condition 1 the abnormality degree of the measurement date b as index data to define the strength of connection between the index data and a plurality of causes of failures, for the condition 2 the abnormality degree of the measurement data c as index data to define the strength of connection between the index data and a plurality of causes of failures, for the condition 3 the abnormality degree of the measurement data d as index data to define the strength of connection between the index data and a plurality of causes of failures, for the condition 4 the abnormality degree of the measurement data c as index data to define the strength of connection between the index data and a plurality of causes of failures, and for the condition 5 the abnormality degree of the measurement data d as index data to define the strength of connection between the index data and a plurality of causes of failures.

* * * * *